US009261856B2

(12) United States Patent
Tsuchiya

(10) Patent No.: US 9,261,856 B2
(45) Date of Patent: Feb. 16, 2016

(54) TONER CONTAINER AND IMAGE FORMING APPARATUS INCLUDING THEREOF

(71) Applicant: KYOCERA Document Solutions Inc., Osaka-shi, Osaka (JP)

(72) Inventor: Hiroaki Tsuchiya, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/491,675

(22) Filed: Sep. 19, 2014

(65) Prior Publication Data

US 2015/0086242 A1 Mar. 26, 2015

(30) Foreign Application Priority Data

Sep. 24, 2013 (JP) ..... 2013-197320

(51) Int. Cl.
*G03G 21/16* (2006.01)
*G03G 15/08* (2006.01)

(52) U.S. Cl.
CPC ..... *G03G 21/1647* (2013.01); *G03G 15/0832* (2013.01); *G03G 15/0865* (2013.01)

(58) Field of Classification Search
CPC ..... G03G 15/0834; G03G 15/0839; G03G 15/0865; G03G 15/0868; G03G 15/0877; G03G 15/0886; G03G 2215/067; G03G 2215/0692; G03G 15/0832; G03G 21/1647
See application file for complete search history.

(56) References Cited

U.S. PATENT DOCUMENTS 7,558,513 B2 * 7/2009 Sugimoto et al. ..... 399/254
8,538,288 B2 * 9/2013 Itabashi ..... 399/102
8,554,107 B2 * 10/2013 Itabashi ..... 399/106
8,577,250 B2 * 11/2013 Itabashi ..... 399/105
8,634,744 B2 * 1/2014 Nishiyama et al. ..... 399/110
8,639,156 B2 * 1/2014 Itabashi ..... 399/110
8,639,163 B2 * 1/2014 Itabashi ..... 399/260
9,014,595 B2 * 4/2015 Itabashi ..... 399/110
2007/0122203 A1 * 5/2007 Sugimoto et al. ..... 399/254
2010/0158575 A1 6/2010 Maeshima et al.
2010/0316395 A1 * 12/2010 Hayashi ..... 399/9

(Continued)

FOREIGN PATENT DOCUMENTS

JP 2005114935 A 4/2005
JP 2010170101 A 8/2010
JP 2012037837 A 2/2012

*Primary Examiner* — David Gray
*Assistant Examiner* — Carla Therrien
(74) *Attorney, Agent, or Firm* — Alleman Hall McCoy Russell & Tuttle LLP

(57) ABSTRACT

Apparatus main body of image forming apparatus includes first rotation portion, second rotation portion, and lever. Toner container includes opening/closing mechanism for opening and closing the toner discharge outlet, and first coupling portion that is provided rotatably with respect to the housing and configured to, when the toner container is attached to the apparatus main body, be coupled with the first rotation portion of the apparatus main body to be integrally rotatable therewith. The opening/closing mechanism includes second coupling portion configured to, when the toner container is attached to the apparatus main body, be coupled with the second rotation portion of the apparatus main body to be integrally rotatable therewith. The opening/closing mechanism is configured to open and close the toner discharge outlet as the second coupling portion is rotated. The second coupling portion and the first coupling portion are configured to rotate in conjunction with each other.

7 Claims, 17 Drawing Sheets

(56) References Cited

U.S. PATENT DOCUMENTS

2011/0280616 A1* 11/2011 Itabashi ..... 399/110
2011/0280618 A1* 11/2011 Itabashi ..... 399/110
2011/0299879 A1* 12/2011 Kamimura ..... 399/110
2012/0003000 A1* 1/2012 Nishiyama et al. ..... 399/110
2012/0039633 A1 2/2012 Itabashi
2014/0348544 A1* 11/2014 Morita ..... 399/258
2015/0016847 A1* 1/2015 Tsuchiya ..... 399/258
2015/0086243 A1* 3/2015 Tsuchiya ..... 399/258

* cited by examiner

TONER CONTAINER AND IMAGE FORMING APPARATUS INCLUDING THEREOF

INCORPORATION BY REFERENCE

This application is based upon and claims the benefit of priority from the corresponding Japanese Patent Application No. 2013-197320 filed on Sep. 24, 2013, the entire contents of which are incorporated herein by reference.

BACKGROUND

The present disclosure relates to a toner container and an image forming apparatus including thereof.

An image forming apparatus such as a copier, a laser printer or the like includes a toner container attached to the apparatus main body. In general, the toner container includes a housing, a toner discharge outlet, and a shutter mechanism. The housing stores the toner. The toner discharge outlet is formed on the housing. The shutter mechanism is able to open and close the toner discharge outlet. Here, in the housing of the toner container, a lever, which is able to drive the shutter mechanism, may be swingably provided.

In addition, in this kind of image forming apparatus, different types of toner are used depending on, for example, specification of image quality, destination, colors of the images, or the like. Accordingly, usually, a suitable type of toner is specified for the image forming apparatus.

When the user uses a not-specified type of toner by mistake, a mechanical failure of the image forming apparatus or an image defect may occur. To prevent this, the compatibility must be eliminated from the toner containers that stores the toner (hereinafter, it is also referred to as "the toner containers have the non-compatible function").

As a technology proposed for this purpose, it is known, for example, that a projection is formed on the toner container at a different position or in a different shape depending on the model of the image forming apparatus, and at the same time, a concave, with which the projection is engaged, is formed on the apparatus main body to which the toner container is attached. For example, as a portion that provides the non-compatible function of the toner container, a step portion, which extends along the insertion direction to the apparatus main body, may be formed on the upper part of the toner container.

SUMMARY

An image forming apparatus according to an aspect of the present disclosure includes an apparatus main body and a toner container attached to the apparatus main body. The apparatus main body includes a first rotation portion, a second rotation portion, and a lever provided integrally with the first rotation portion. The first rotation portion and the second rotation portion are provided each rotatably, in alignment with each other. The toner container includes a housing for storing toner, a toner discharge outlet formed on the housing, an opening/closing mechanism provided on the housing and configured to open and close the toner discharge outlet, and a first coupling portion that is provided rotatably with respect to the housing and configured to, when the toner container is attached to the apparatus main body, be coupled with the first rotation portion of the apparatus main body to be integrally rotatable therewith. The opening/closing mechanism includes a second coupling portion configured to, when the toner container is attached to the apparatus main body, be coupled with the second rotation portion of the apparatus main body to be integrally rotatable therewith. The opening/closing mechanism is configured to open and close the toner discharge outlet as the second coupling portion is rotated. The second coupling portion and the first coupling portion are configured to rotate in conjunction with each other.

A toner container according to another aspect of the present disclosure includes a housing, a toner discharge outlet, an opening/closing mechanism, and a first coupling portion. The housing is attached to an apparatus main body of an image forming apparatus and is configured to store toner. The toner discharge outlet is formed on the housing. The opening/closing mechanism is provided on the housing and opens and closes the toner discharge outlet. The first coupling portion is provided rotatably with respect to the housing. The apparatus main body includes a first rotation portion, a second rotation portion, and a lever. The first rotation portion and the second rotation portion are provided each rotatably, in alignment with each other. The lever is provided integrally with the first rotation portion. The first coupling portion is configured to, when the toner container is attached to the apparatus main body, be coupled with the first rotation portion of the apparatus main body to be integrally rotatable therewith. The opening/closing mechanism includes a second coupling portion configured to, when the toner container is attached to the apparatus main body, be coupled with the second rotation portion of the apparatus main body to be integrally rotatable therewith, the opening/closing mechanism being configured to open and close the toner discharge outlet as the second coupling portion is rotated. The second coupling portion and the first coupling portion are configured to rotate in conjunction with each other.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It is noted that the present disclosure is not limited to the following embodiment.

<Image Forming Apparatus>

Figure 1:
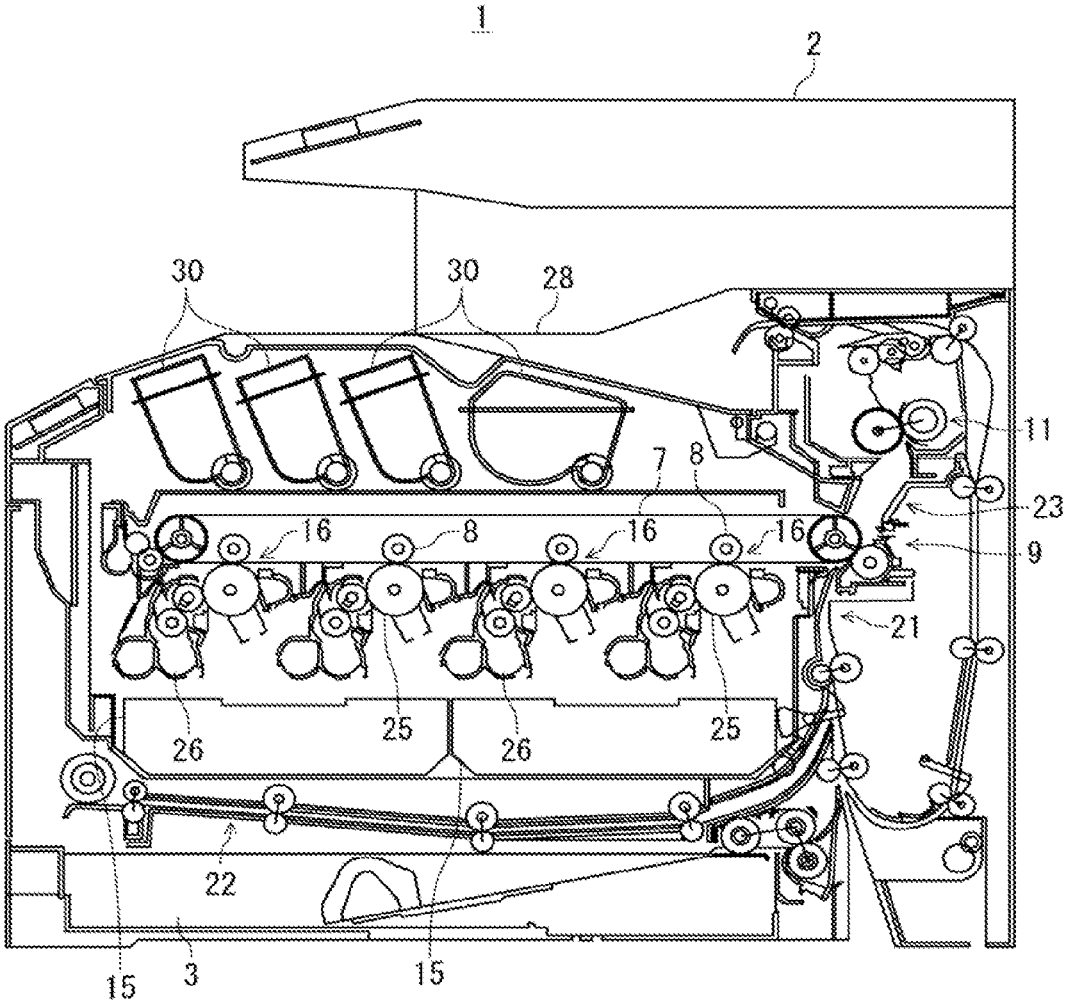
FIG. 1 is a cross-sectional view showing an outlined configuration of a laser printer as an image forming apparatus in the present embodiment.

FIG. 1 is a cross-sectional view showing an outlined configuration of an image forming apparatus 1. The image forming apparatus 1 is, for example, a tandem color printer. As shown in FIG. 1, the image forming apparatus 1 includes an apparatus main body 2 and toner containers 30 that are toner containers attached to the apparatus main body. The apparatus main body 2 includes an intermediate transfer belt 7, primary transfer portions 8, a secondary transfer portion 9, a fixing device 11, a laser scanning unit 15, and a plurality of image forming portions 16.

A sheet feed cassette 3 is disposed at an internal lower part of the apparatus main body 2 of the image forming apparatus 1. The sheet feed cassette 3 houses inside a stack of sheets (not shown) such as paper sheets before printing. On the side of the sheet feed cassette 3, there is provided a first paper sheet conveying portion 21 extending upward. The first paper sheet conveying portion 21 receives a paper sheet fed from the sheet feed cassette 3, and conveys the paper sheet to a secondary transfer portion 9 provided thereabove. Above the sheet feed cassette 3, a second paper sheet conveying portion 22 is provided to receive a paper sheet or the like fed from a manual sheet feed portion (not shown) and conveys it to the first paper sheet conveying portion 21.

The laser scanning unit 15 is disposed above the second paper sheet conveying portion 22 and emits laser light to the image forming portions 16 based on image data received by the image forming apparatus 1. For example, two laser scanning units 15, which emit laser light to two image forming portions 16, are disposed in alignment. Four image forming portions 16 are disposed above the laser scanning units 15. Above the image forming portions 16, the intermediate transfer belt 7 of an endless shape is provided. The intermediate transfer belt 7 is wound around a plurality of rollers, and is driven and rotated by a driving device not shown.

As shown in FIG. 1, the four image forming portions 16 are aligned along the intermediate transfer belt 7, and respectively form toner images of yellow, magenta, cyan, and black. Each of the image forming portions 16 includes a photoconductor drum 25 and a developing device 26, wherein the photoconductor drum 25 is a photoconductor, and the developing device 26 is disposed on the peripheral of the photoconductor drum 25. That is, in each image forming portion 16, an electrostatic latent image of a document sheet image is formed on the photoconductor drum 25 by the laser light emitted from the laser scanning unit 15, and the electrostatic latent image is developed by the developing device 26, allowing for toner images of respective colors to be formed.

The toner containers 30 are disposed above the intermediate transfer belt 7. Specifically, toner containers 30 containing toners of yellow, magenta, cyan, and black are disposed in alignment along the intermediate transfer belt 7. The toner containers 30 are configured to supply toner of the colors to the corresponding developing devices.

The primary transfer portions 8 are disposed above the respective image forming portions 16. The primary transfer portions 8 include transfer rollers for primarily transferring the toner images formed by the image forming portions 16 onto the intermediate transfer belt 7.

Toner images of respective image forming portions 16 are transferred onto the intermediate transfer belt 7 at predetermined timings while the intermediate transfer belt 7 is driven to be rotated so that toner images of four colors of yellow, magenta, cyan, and black are overlaid with each other on the surface of the intermediate transfer belt 7, thereby forming a color toner image.

The secondary transfer portion 9 is configured to transfer the toner image from the intermediate transfer belt 7 to a paper sheet by applying a transfer bias voltage of a polarity opposite to a polarity of the toner to the paper sheet conveyed from the first paper sheet conveying portion 21.

The fixing device 11 is provided above the secondary transfer portion 9. Between the fixing device 11 and the secondary transfer portion 9, there is formed a third paper sheet conveying portion 23 that conveys a paper sheet, on which a toner image has been secondarily transferred, to the fixing device 11. The fixing device 11 applies heat and pressure to the paper sheet conveyed from the third paper sheet conveying portion 23, thereby fixing the toner image on the paper sheet. The paper sheet discharged from the fixing device 11 is discharged onto a paper sheet discharge portion 28 formed above the apparatus main body 2.

Meanwhile, to restrict use of the types of toner which are different from the type of toner suitable for the image forming apparatus 1, it is desirable that as many shape patterns as possible are provided for the portion having the non-compatible function. However, when the portion providing non-compatible function is configured to have the restricted shape of the step portion that is formed above the toner containers 30 and extends along the direction in which the toner containers 30 are inserted into the apparatus main body, it is difficult to prepare a various number of shape patterns for the portion providing the non-compatible function. In addition, there is a problem that when the lever for opening/closing the toner discharge outlet of the toner container 30 is operated by mistake before the toner container 30 is attached to the apparatus main body, the toner is leaked from the toner container 30. With regard to these problems, the image forming apparatus 1 can appropriately restrict use of the types of toner which are different from the type of toner suitable for the image forming apparatus 1.

<Toner Container>

FIGS. 2 through 7 show configurations of the toner containers 30 in the present embodiment.

As shown in FIGS. 1 through 4, each toner container 30 includes a housing 31, a toner discharge outlet 32, and an opening/closing mechanism 33. The housing 31 stores the toner, and is attached to the apparatus main body 2 of the image forming apparatus 1. The toner discharge outlet 32 is formed on the housing 31. The opening/closing mechanism 33 is provided on the housing 31 and opens and closes the toner discharge outlet 32.

Figure 2:
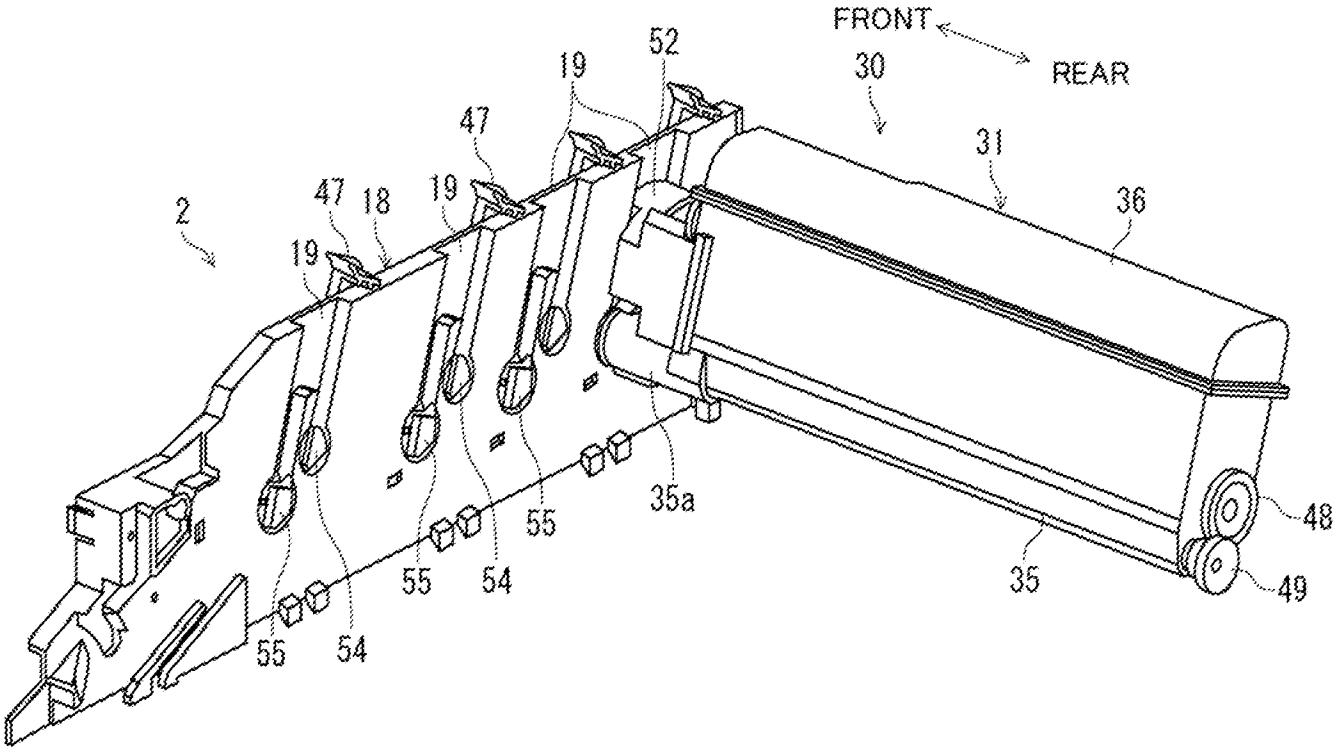
FIG. 2 is a perspective view showing a toner container together with an attachment portion.

As shown in FIG. 2, the apparatus main body 2 includes a plate-like attachment portion 18 to which the housings 31 are attached. In a surface of one side of the attachment portion 18, a plurality of container guides 19 are formed which are groove-like and extend diagonally upward. Each housing 31 is guided diagonally downward by a container guide 19 and is attached to the attachment portion 18.

The housing 31 is made of a resin material and formed in the shape of a box extending in the front-rear direction. Here, the front-rear direction is defined as a longitudinal direction of the housing 31. In addition, it is assumed that in FIG. 3, the right side is the front side and the left side is the rear side.

Figure 3:
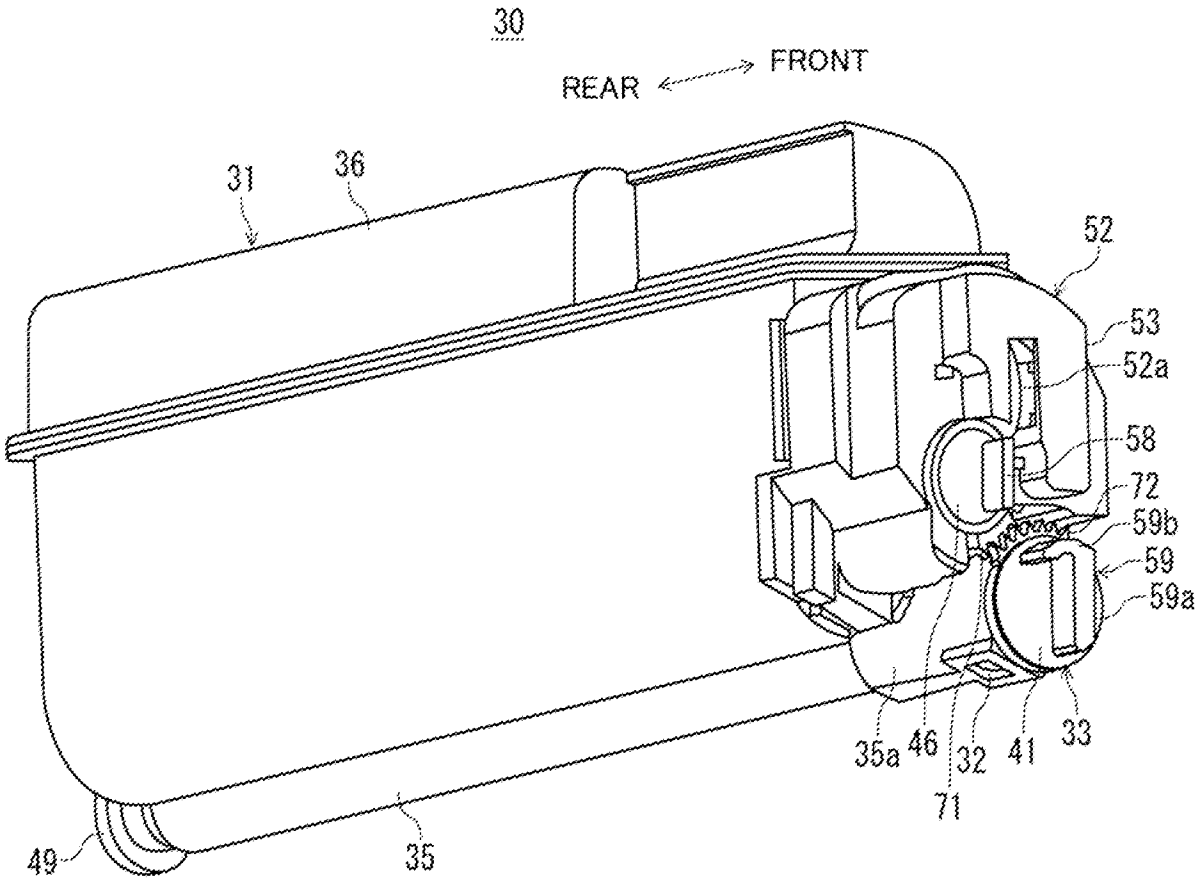
FIG. 3 is a perspective view showing an outer appearance of the toner container.
Figure 4:
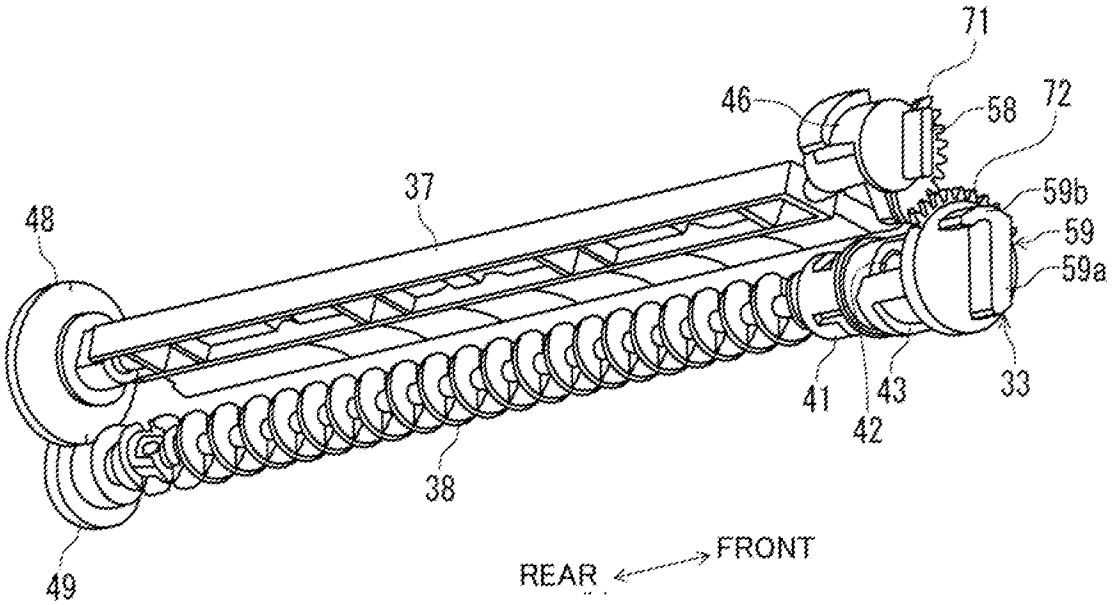
FIG. 4 is a perspective view showing an opening/closing mechanism, a stirring mechanism and a screw portion.

As shown in FIG. 3, the housing 31 includes a container main body 35 and a lid 36. The upper part of the container main body 35 is opened, and the container main body 35 has a bottom. The lid 36 closes the opening part of the container main body 35. As shown in FIG. 4, a stirring paddle 37 and a screw portion 38 are provided inside the container main body 35. The stirring paddle 37 is configured to stir the toner. The screw portion 38 is configured to convey the toner to the toner discharge outlet 32.

Figure 5:
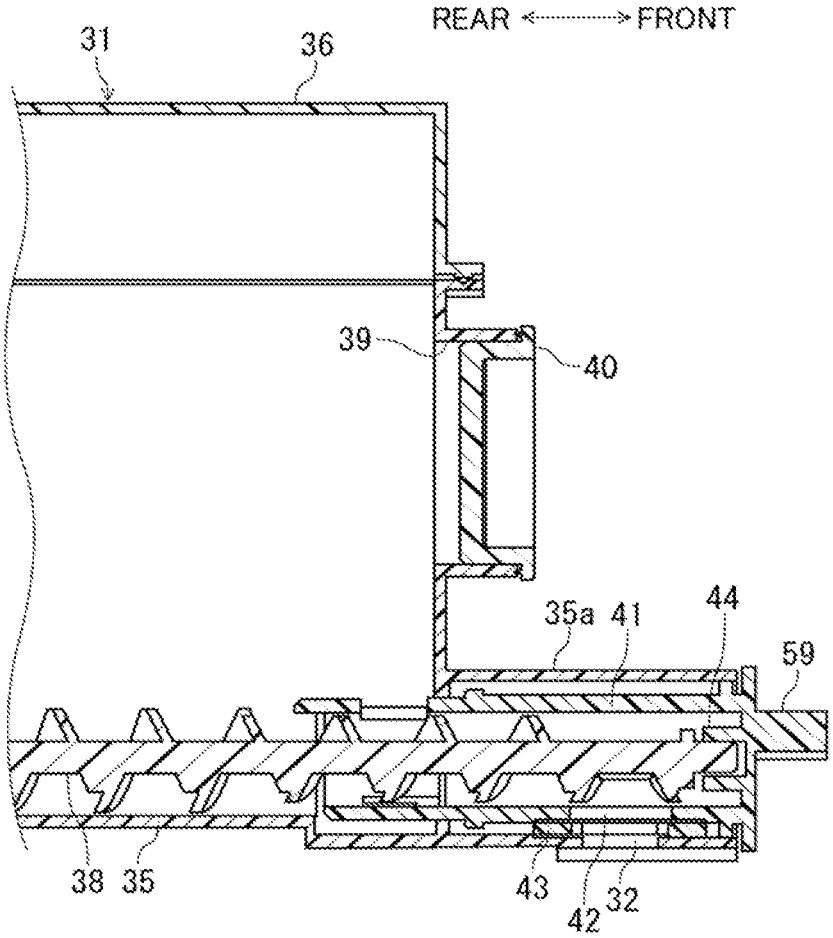
FIG. 5 is a cross-sectional view showing the configuration of the opening/closing mechanism.

As shown in FIG. 5, a toner filling opening 39 is provided on a side wall of the front part of the container main body 35. The toner filling opening 39 enables the toner to be filled into the housing 31. The toner filling opening 39 is closed by a plug 40.

As shown in FIGS. 3 and 5, the toner discharge outlet 32 is formed on the front-end side-bottom part of the container main body 35. That is, an approximately cylindrical protruding portion 35*a* protruding in the front direction is formed on the front-end part of the container main body 35. The toner discharge outlet 32 is formed such that it passes through a peripheral wall of the protruding portion 35*a* downward.

As shown in FIGS. 4 and 5, the opening/closing mechanism 33 includes a shutter cylinder 41, an opening 42, and a seal member 43. The shutter cylinder 41 is inserted through the protruding portion 35*a* of the container main body 35 and its front end is closed. The opening 42 is formed in a side surface of the shutter cylinder 41. The seal member 43 is provided at the inner wall surface of the protruding portion 35*a* on the peripheral of the toner discharge outlet 32.

On the inner side of the front-end part of the shutter cylinder 41, a bearing 44 is formed to rotatably support the screw portion 38. The seal member 43 is able to prevent the toner from scattering.

The shutter cylinder 41 is rotatably attached to the protruding portion 35*a*. During the rotation of the shutter cylinder 41, when the opening 42 of the shutter cylinder 41 overlaps with the toner discharge outlet 32, the toner discharge outlet 32 is opened and the toner in the housing 31 can be discharged to the developing device 26 via the toner discharge outlet 32. On the other hand, when the peripheral wall of the shutter cylinder 41, where the opening 42 is not formed, overlaps with the toner discharge outlet 32, the toner discharge outlet 32 is closed. That is, as the shutter cylinder 41 is rotated, the toner discharge outlet 32 is opened and closed.

Figure 7:
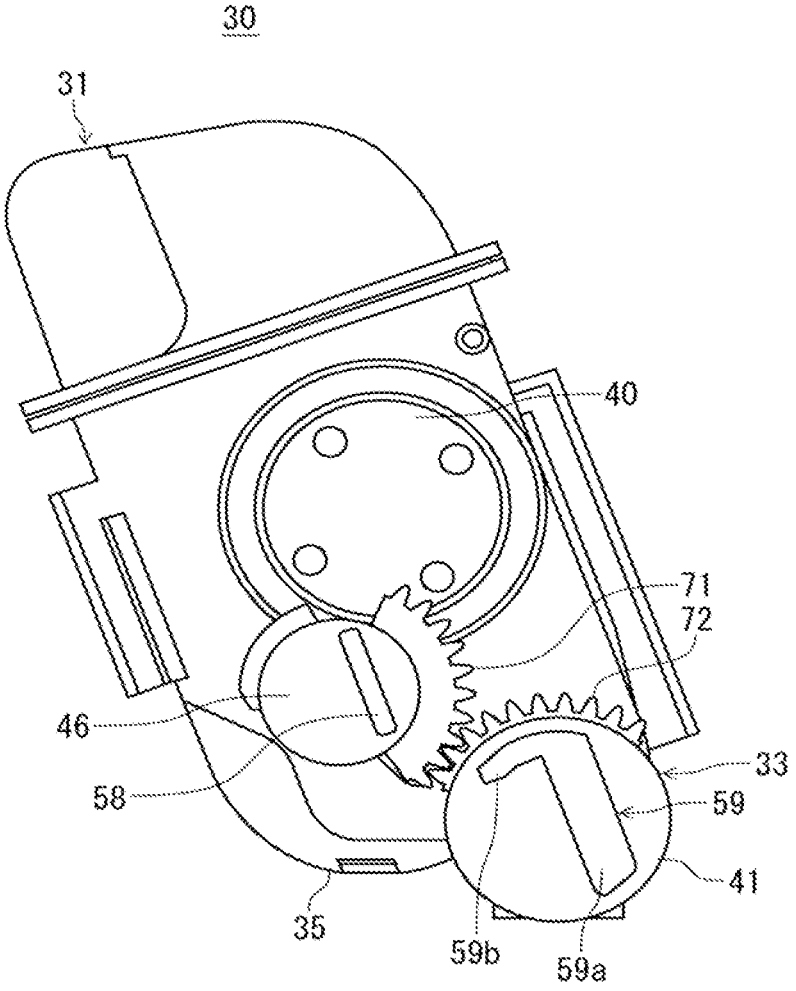
FIG. 7 is a front view showing the toner container without the cover member.

As shown in FIG. 7, a shaft portion 46 is provided rotatably in the front-end part of the container main body 35. The shaft portion 46 has an axis that extends in the front-rear direction.

As shown in FIG. 4, the front end of the stirring paddle 37 is rotatably supported by the inside of the shaft portion 46. On the other hand, the rear end of the stirring paddle 37 is coupled with a stirring gear 48. In addition, the rear end of the screw portion 38 is coupled with a driving gear 49. As shown in FIG. 2, the stirring gear 48 and the driving gear 49 are disposed in the rear-end part of the container main body 35.

Figure 6:
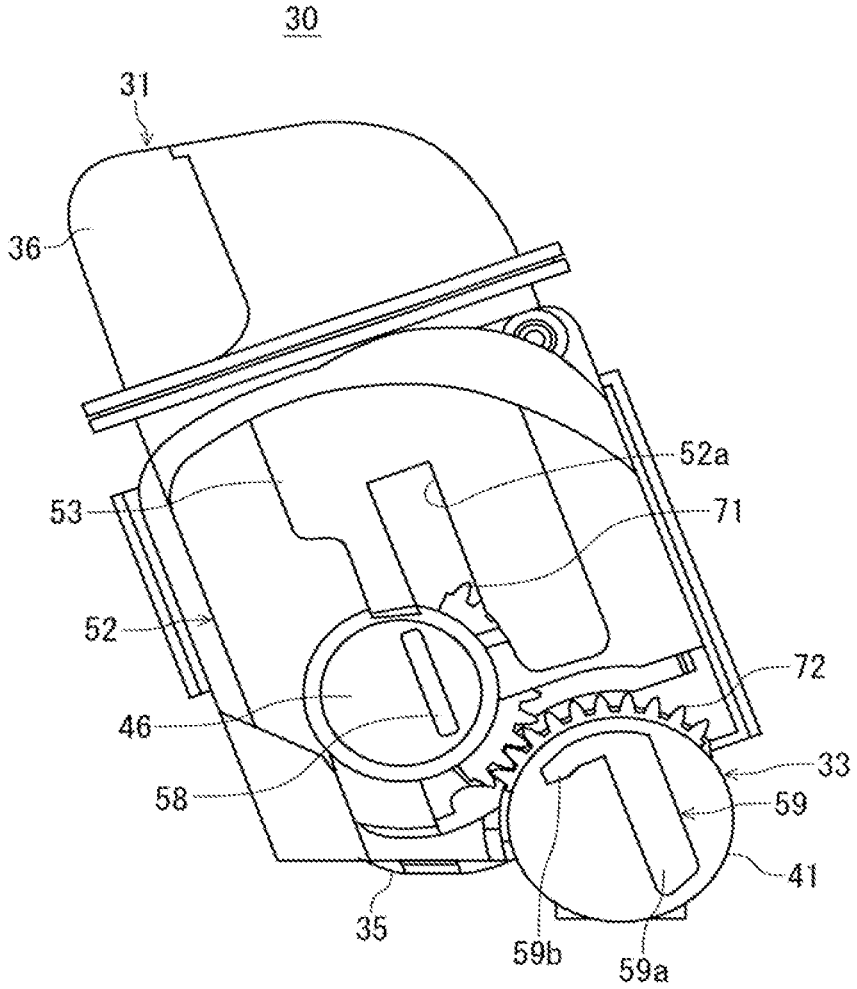
FIG. 6 is a front view showing an outer appearance of the toner container.

As shown in FIGS. 3 and 6, a cover member 52 is attached to the front-end part of the container main body 35. The cover member 52 includes a positioning projection 53 that is block-like and protrudes in the front direction. The positioning projection 53 has a slit 52*a* that extends in the up-down direction and is opened downward.

The width of the positioning projection 53 is approximately the same as the groove width of the container guide 19. As shown in FIG. 2, when the positioning projection 53 is fitted in the container guide 19 and guided by the container guide 19 diagonally downward, the housing 31 is attached to the attachment portion 18.

Figure 8:
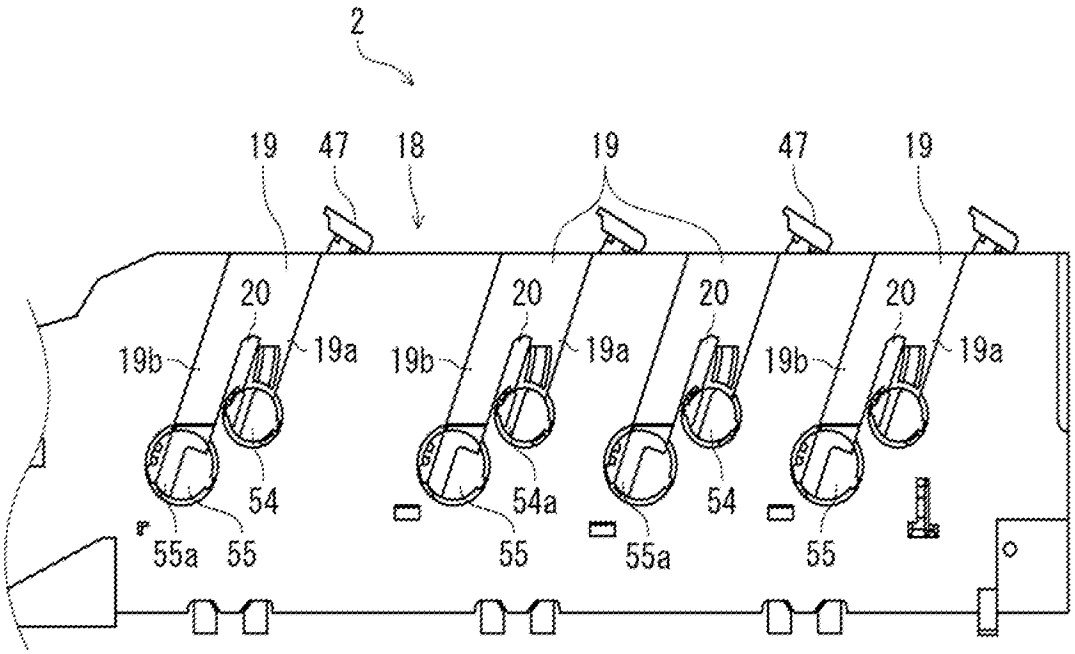
FIG. 8 is a rear view showing an outer appearance of the attachment portion.
Figure 9:
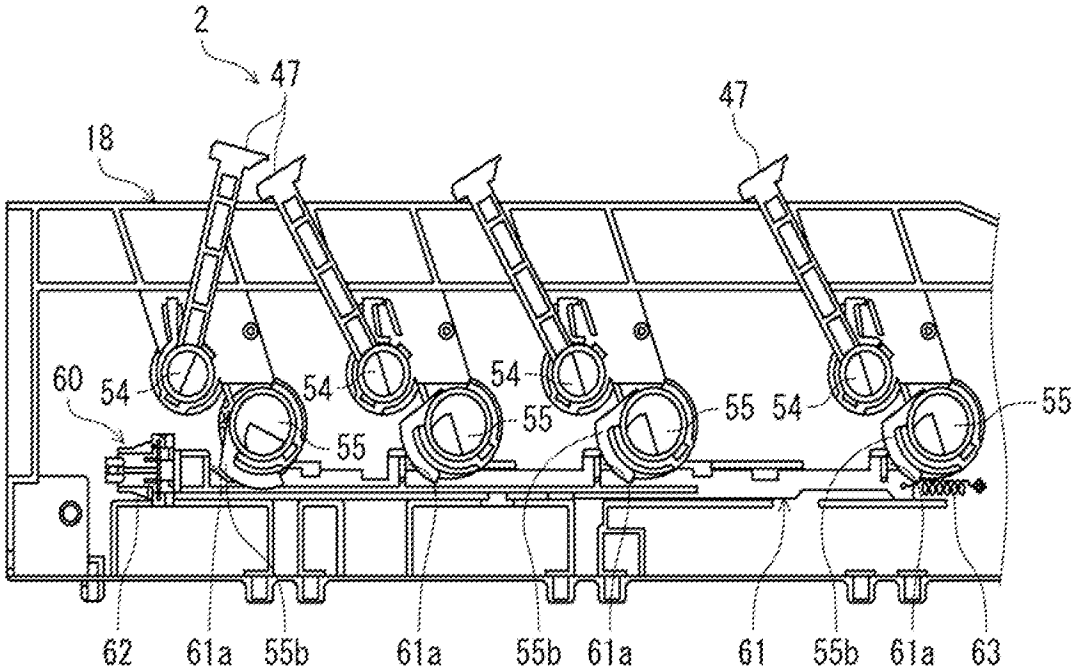
FIG. 9 is a front view showing the attachment portion to which a container has been attached.
Figure 10:
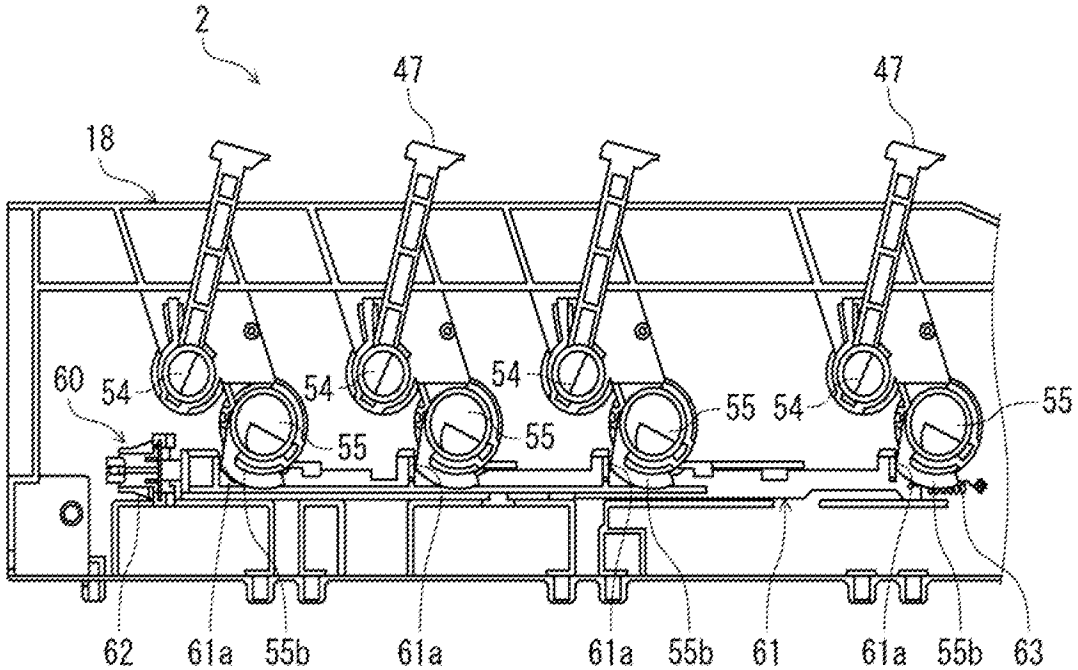
FIG. 10 is a front view showing the attachment portion to which four containers have been attached.
Figure 11:
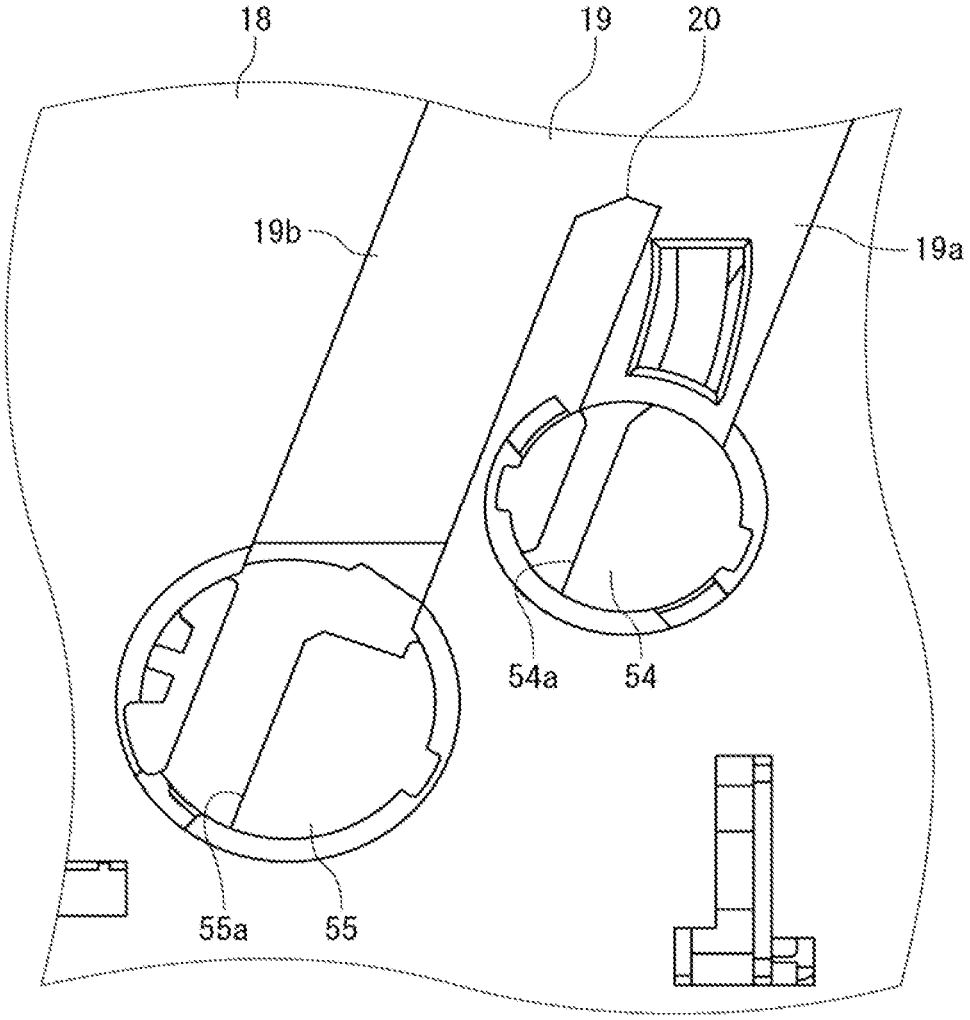
FIG. 11 is a rear view showing an enlargement of the first rotation portion and the second rotation portion.
Figure 12:
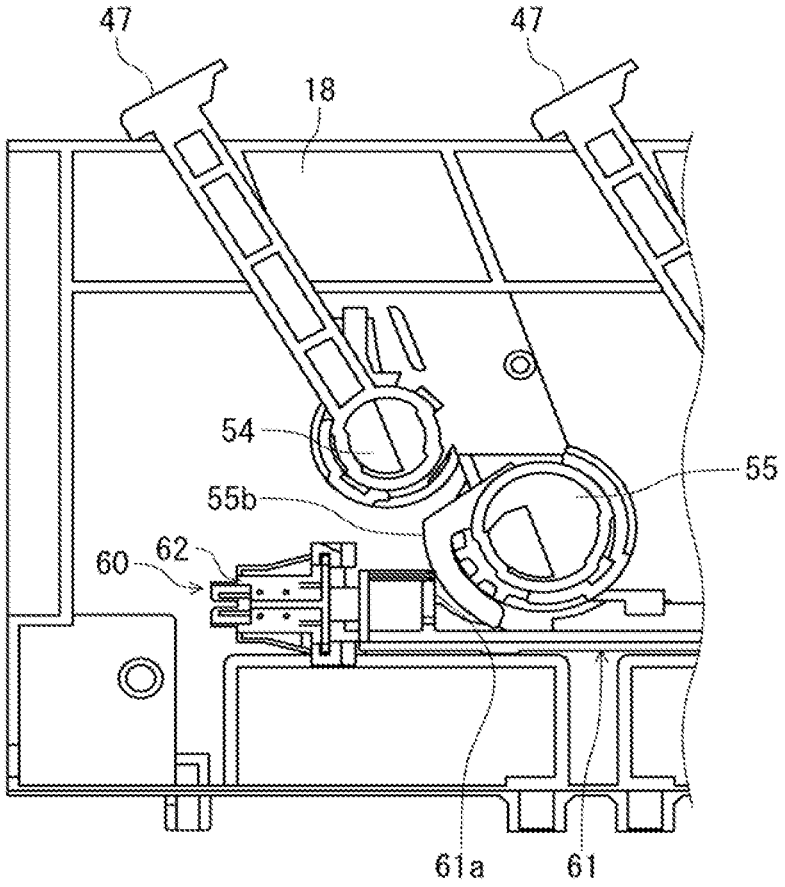
FIG. 12 is a front view showing an enlargement of the first rotation portion and the second rotation portion.
Figure 13:
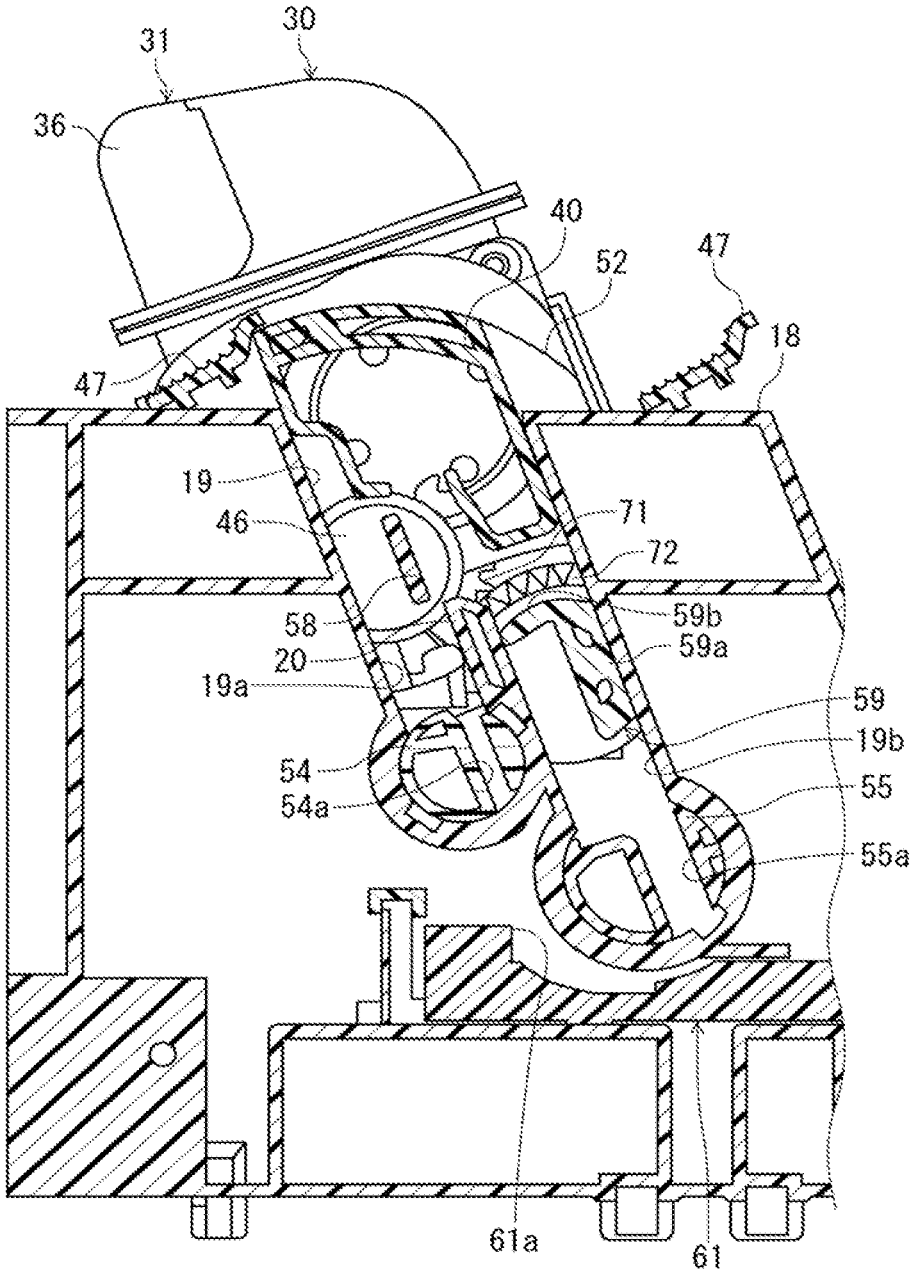
FIG. 13 is a partially broken front view showing a toner container attached to the attachment portion.
Figure 14:
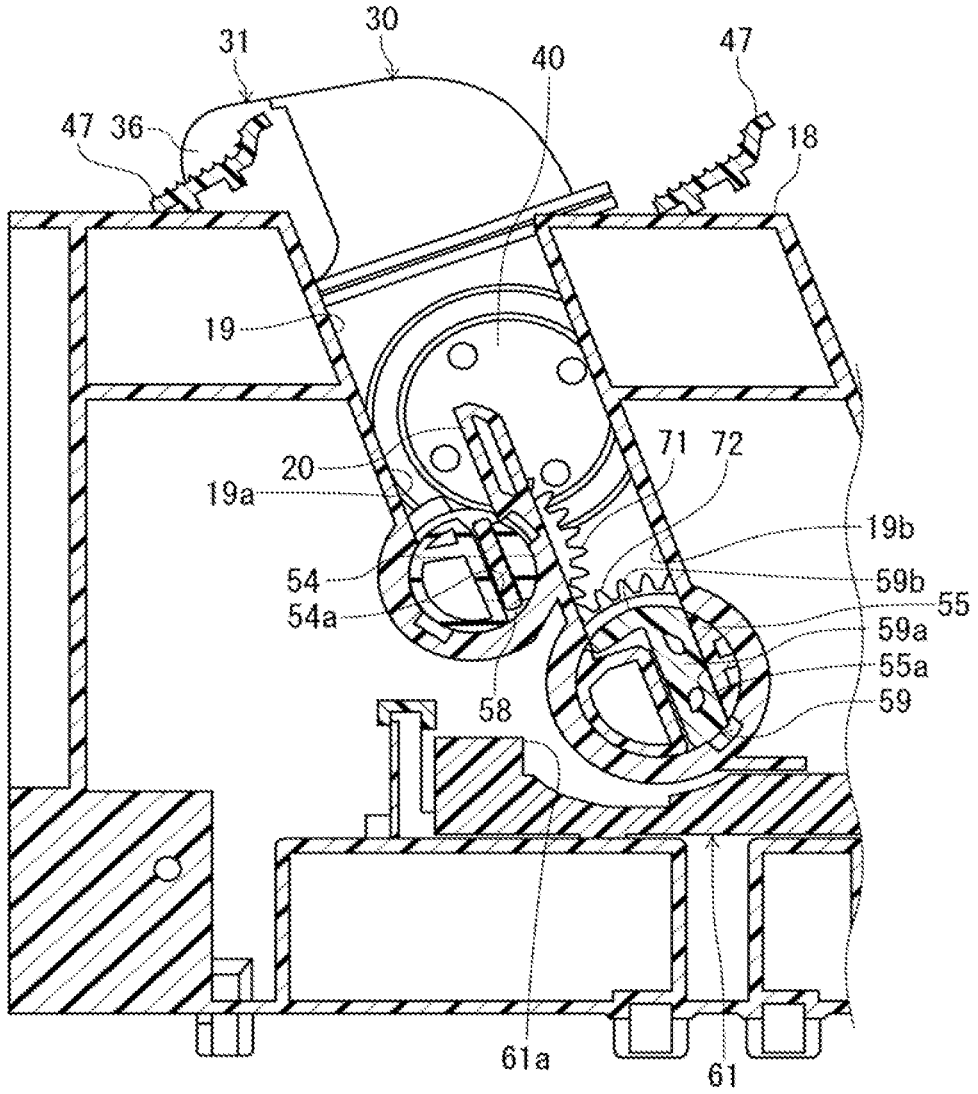
FIG. 14 is a partially broken front view showing a toner container attached to the attachment portion.

FIGS. 8 through 10 show outer appearances of the attachment portion 18. FIGS. 11 and 12 show enlargements of a first rotation portion 54 and a second rotation portion 55. FIGS. 13 and 14 show a toner container 30 attached to the attachment portion 18.

As shown in FIGS. 8 and 11, in the attachment portion 18, the lower portion of the container guide 19 is branched into a first groove portion 19*a* and a second groove portion 19*b* so that the two branched portions of the cover member 52 are attached thereto. Between the first groove portion 19*a* and the second groove portion 19*b*, a projection strip 20 is formed to extend along the first groove portion 19*a* and the second groove portion 19*b*. When the cover member 52 is guided by the container guide 19 diagonally downward to the attachment position, the projection strip 20 is inserted into a slit 52*a* of the cover member 52.

As shown in FIGS. 8 through 12, the first rotation portion 54 and the second rotation portion 55 are provided, each rotatably, in alignment with each other in the attachment portion 18. The attachment portion 18 includes four pairs of first rotation portion 54 and second rotation portion 55 in correspondence with the four toner containers 30, respectively.

The first rotation portion 54 is disposed at the lower end of the first groove portion 19*a* of each container guide 19 and is supported rotatably by the attachment portion 18. On the other hand, the second rotation portion 55 is disposed at the lower end of the second groove portion 19*b* and is supported rotatably by the attachment portion 18.

In addition, the attachment portion 18 includes a lever 47 provided integrally with the first rotation portion 54. The lever 47 is configured to be swung around the axis of the first rotation portion 54 when the first rotation portion 54 is rotated.

On the other hand, as shown in FIGS. 7 and 14, each toner container 30 includes a first coupling portion 58. The first coupling portion 58 is provided rotatably with respect to the housing 31, and when the toner container 30 is attached to the apparatus main body 2, the first coupling portion 58 is coupled with the first rotation portion 54 of the apparatus main body 2 to be integrally rotatable therewith.

The first coupling portion 58 is formed integrally with the front end of the shaft portion 46 and formed in the shape of a plate protruding in the front direction. The first coupling portion 58 extends linearly in the attachment direction in which, when the housing 31 is attached to the attachment portion 18, the cover member 52 is guided by the container guide 19 (i.e., extends diagonally downward).

As shown in FIG. 11, the first rotation portion 54 of the apparatus main body 2 has a first coupling groove 54*a* with which the first coupling portion 58 of the toner container 30 is coupled. The first coupling groove 54*a* extends linearly at least in part. On the other hand, the first coupling portion 58 is shaped such that it is fitted in the first coupling groove 54*a*.

That is, the groove width of the first coupling groove 54*a* is approximately the same as the plate thickness of the first coupling portion 58. With this configuration, when the housing 31 is attached to the apparatus main body 2, the first coupling portion 58 is inserted into the first coupling groove 54*a* and is coupled with the first rotation portion 54 to be integrally rotatable therewith.

In addition, as shown in FIG. 7, the opening/closing mechanism 33 of the toner containers 30 includes a second coupling portion 59 that integrally rotates with the shutter cylinder 41. The second coupling portion 59 is formed integrally with the front end of the shutter cylinder 41 and protrudes in the front direction. The second coupling portion 59 is formed in the shape of a hook in a cross section perpendicular to the axis direction of the shutter cylinder 41.

Specifically, the second coupling portion 59 includes a first portion 59*a* and a second portion 59*b*. The first portion 59*a* extends linearly in the attachment direction in which, when the housing 31 is attached to the attachment portion 18, the cover member 52 is guided by the container guide 19 (i.e., extends diagonally downward). The second portion 59*b* extends from the upper end part of the first portion 59*a* in one of the rotational directions of the shutter cylinder 41. The first portion 59*a* is greater than the first coupling portion 58 in plate thickness.

As shown in FIG. 11, the second rotation portion 55 of the apparatus main body 2 has a second coupling groove 55*a* formed to be coupled with the second coupling portion 59 of the toner container 30. The second coupling groove 55*a* extends linearly at least in part. On the other hand, the second coupling portion 59 is shaped such that it is fitted in the second coupling groove 55*a*. That is, the groove width of the second coupling groove 55*a* is approximately the same as the plate thickness of the first portion 59*a* of the second coupling portion 59. As a result, the second coupling groove 55*a* is different from the first coupling groove 54*a* in groove width.

When the toner containers 30 is attached to the attachment portion 18, the second coupling portion 59 is inserted into the second coupling groove 55*a* and is coupled with the second rotation portion 55 to be integrally rotatable therewith. The opening/closing mechanism 33 is configured to open and close the toner discharge outlet 32 as the second coupling portion 59 rotates.

As shown in FIG. 12, each second rotation portion 55 includes an arm 55*b* provided on a side of the attachment portion 18 opposite to the side on which the container guides 19 are formed. The arm 55*b* is formed integrally with the second rotation portion 55 to extend in one of the rotational directions of the second rotation portion 55. The arm 55*b* has an outer circumferential side surface that is in a circular arc shape.

The first coupling portion 58 and the second coupling portion 59 are configured in the non-compatible shape which is a shape that allows for attachment of the housing 31 to the apparatus main body 2 of a predetermined model, while not allowing for attachment of the housing 31 to the apparatus main body 2 of the other models. For example, depending on the model or the like of the image forming apparatus 1, the first coupling portion 58, the second coupling portion 59, the first coupling groove 54*a* of the first rotation portion 54, and the second coupling groove 55*a* of the second rotation portion 55 are provided at different positions, in different shapes, or the like.

In addition, the first coupling portion 58 and the second coupling portion 59 are configured to rotate in conjunction with each other. That is, as shown in FIG. 7, each toner container 30 includes a first gear 71 that integrally rotates with the first coupling portion 58. Furthermore, the opening/closing mechanism 33 includes a second gear 72 that meshes with the first gear 71 and integrally rotates with the second coupling portion 59.

The first gear 71 is integrally formed with the shaft portion 46, and the second gear 72 is integrally formed with the shutter cylinder 41. The second coupling portion 59 is configured to rotate in a direction that is opposite to the rotational direction of the first coupling portion 58.

As shown in FIGS. 9 and 10, a detection mechanism 60 is provided on the attachment portion 18. The detection mechanism 60 detects that the toner discharge outlets 32 of the toner containers 30 attached to the apparatus main body 2 are in the open state. The detection mechanism 60 of the present embodiment detects that all of the toner discharge outlets 32 of the plurality of toner containers 30 attached to the attachment portion 18 are in the open state by detecting that all of the second rotation portions 55 were rotated.

The detection mechanism 60 includes the second rotation portions 55, a detection bar 61, and a sensor 62. The detection bar 61 extends along the surface of the attachment portion 18 in the alignment direction of the four second rotation portions 55. The sensor 62 is provided at one end of the detection bar 61 and is able to detect that the second rotation portions 55 rotated. The other end of the detection bar 61 is connected to a tension spring 63.

Figure 15:
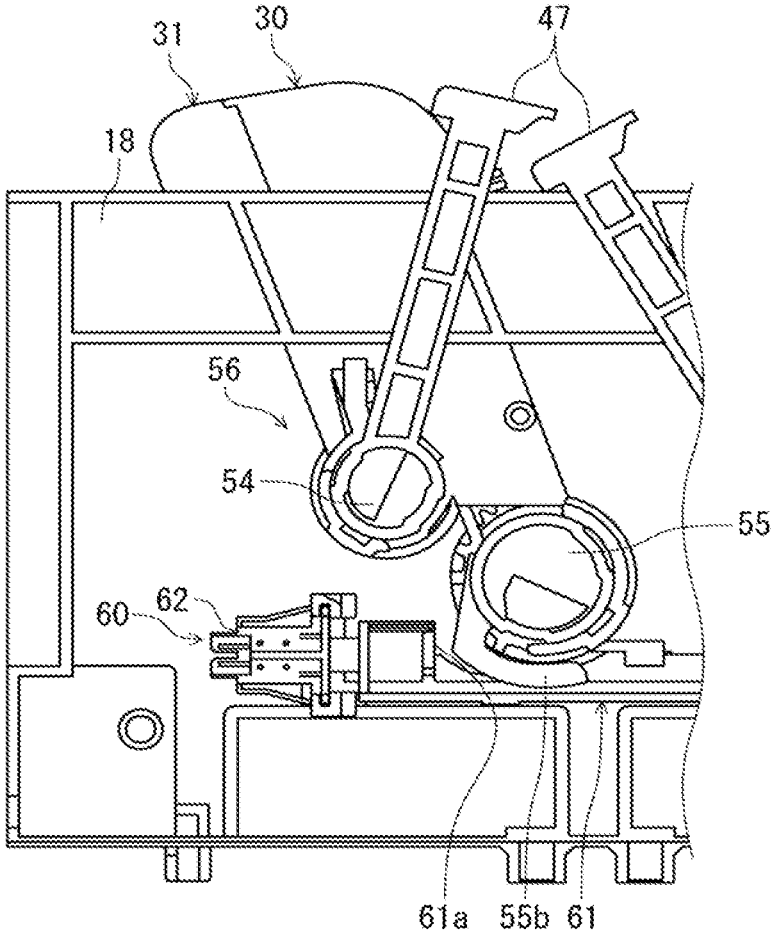
FIG. 15 is a front view showing the attachment portion and the toner container with the lever swung.

The detection bar 61 includes locking portions 61*a* that are respectively locked to the arms 55*b* of the second rotation portions 55. Four locking portions 61*a* are provided in correspondence with the four arms 55*b*. As shown in FIG. 12, when the toner discharge outlet 32 is closed, the locking portions 61*a* are locked to the arms 55*b*, thereby restricting the detection bar 61 from moving toward the tension spring 63 (the right side in FIG. 12). On the other hand, as shown in FIG. 15, when the toner discharge outlet 32 is opened, the second rotation portions 55 are rotated anticlockwise and the locking portions 61*a* are not locked to the circular-arc outer circumferential side surfaces of the arms 55*b*.

As shown in FIG. 10, when all of the toner discharge outlets 32 are opened, all of the locking portions 61*a* are not locked to the outer circumferential side surfaces of the arms 55*b*, and the detection bar 61 is pulled rightward in FIG. 10 by the tension spring 63 and moved away from the sensor 62.

When the detection bar 61 is close to the sensor 62 as shown in FIG. 9, the sensor 62 detects the ON state where at least one toner discharge outlet 32 is closed. On the other hand, when the detection bar 61 has moved away from the sensor 62 as shown in FIG. 10, the sensor 62 detects the OFF state where all of the toner discharge outlets 32 are opened. In this way, the detection mechanism 60 detects, based on the detection result of the sensor 62, that the toner discharge outlets 32 of the toner containers 30 attached to the apparatus main body 2 are in the open state.

Next, the attachment/detachment operation of the toner containers 30 to/from the apparatus main body 2 is explained.

Before the toner container 30 is attached to the apparatus main body 2, the toner discharge outlet 32 is closed by the shutter cylinder 41. Here, as shown in FIGS. 6 and 7, the first coupling portion 58 and the first portion 59*a* of the second coupling portion 59 respectively extend in the attachment direction in which the cover member 52 is guided by the container guide 19 (i.e., extend diagonally downward).

In addition, as shown in FIG. 11, before the toner container 30 is attached to the apparatus main body 2, the first coupling groove 54*a* of the first rotation portion 54 and the second coupling groove 55*a* of the second rotation portion 55 extend in the direction in which the container guides 19 extend (i.e., the attachment direction in which the cover member 52 is guided).

When the toner container 30 is attached to the attachment portion 18, the cover member 52 is inserted into the container guide 19 of the attachment portion 18. The cover member 52 is then guided by the container guide 19 diagonally downward. Furthermore, as shown in FIGS. 13 and 14, the first coupling portion 58 of the toner container 30 is guided by the first groove portion 19*a*, and the second coupling portion 59 is guided by the second groove portion 19*b*. This leads to the first coupling portion 58 being coupled with the first coupling groove 54*a* of the first rotation portion 54, and the second coupling portion 59 being coupled with the second coupling groove 55*a* of the second rotation portion 55.

Next, the toner discharge outlet 32 is opened by swinging the lever 47 of the attachment portion 18. Here, FIGS. 15 through 17 show the state where the lever 47 has been swung.

Figure 16:
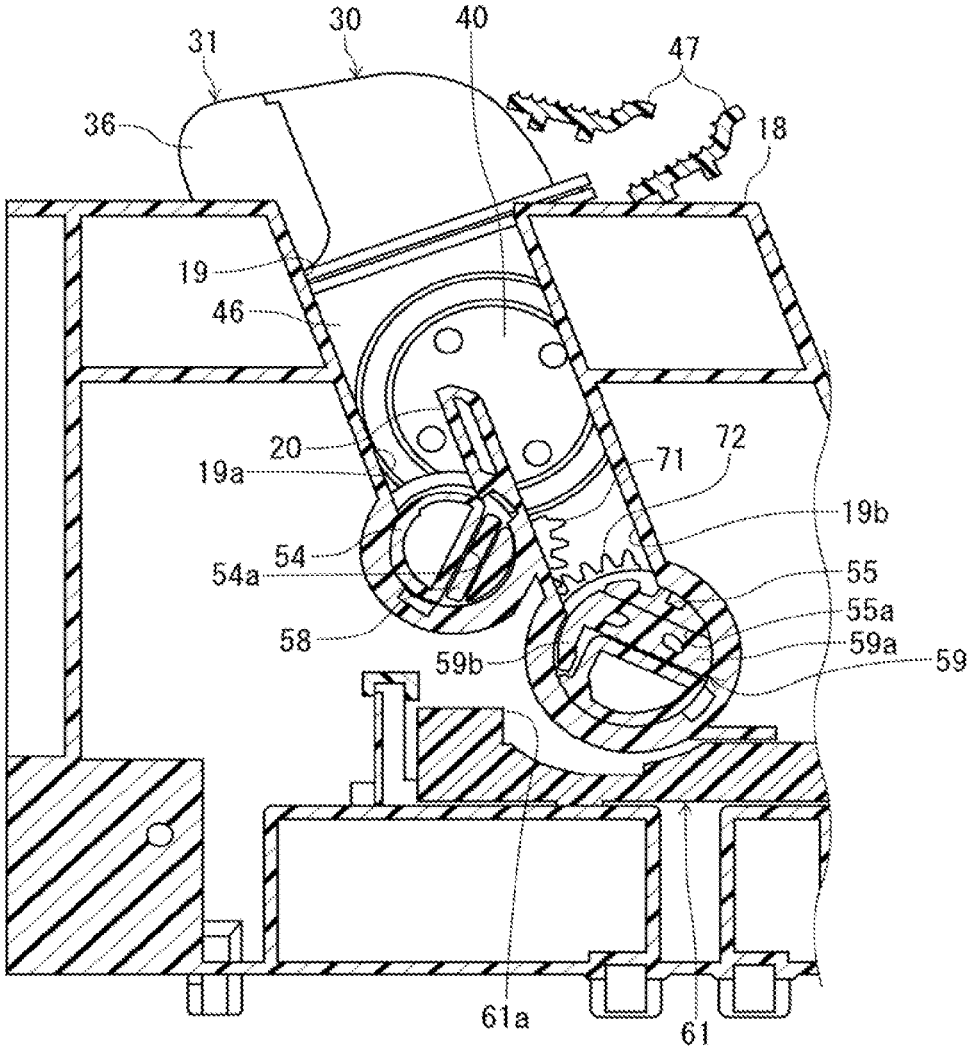
FIG. 16 is a partially broken front view showing the toner container after it is attached to the attachment portion and the lever is swung.
Figure 17:
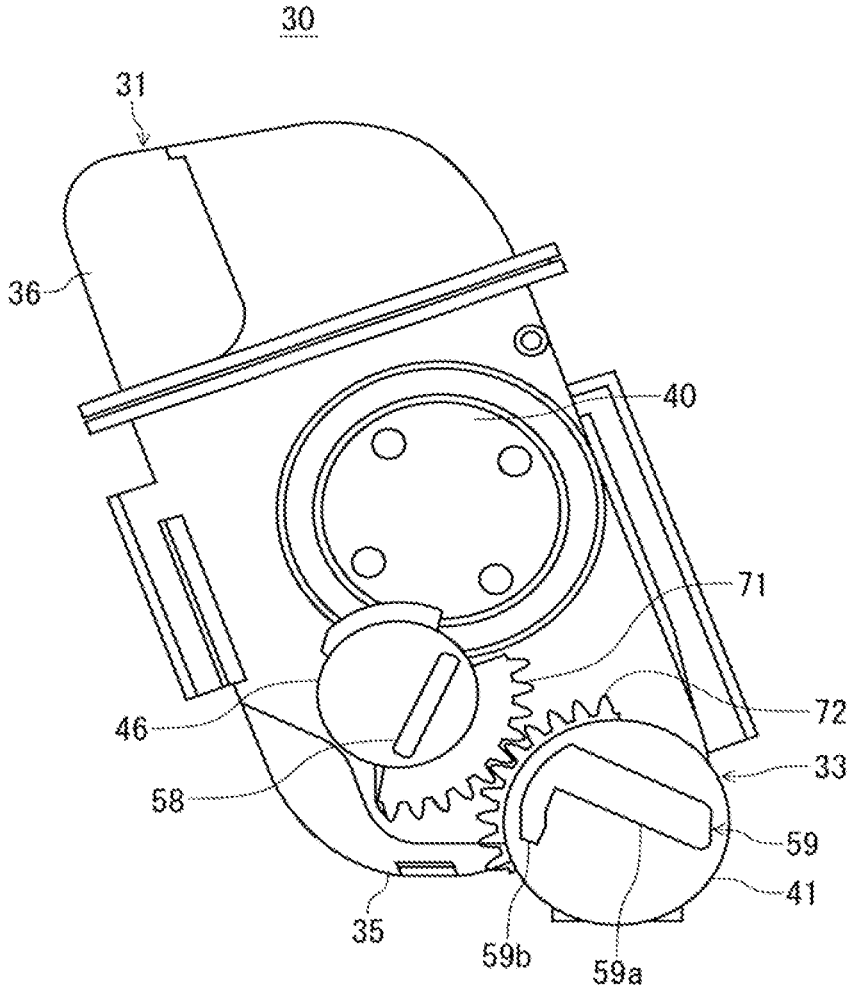
FIG. 17 is a front view showing the toner container with the first and second coupling portions rotated.

When the lever 47 is swung in the state where the toner container 30 has been attached to the attachment portion 18, the first rotation portion 54 is integrally rotated with the lever 47 clockwise as shown in FIGS. 14 through 16. Since the first rotation portion 54 is coupled with the first coupling portion 58, the first rotation portion 54 integrally rotates with the first coupling portion 58 and the shaft portion 46.

Here, the first gear 71, which integrally rotates with the first coupling portion 58, meshes with the second gear 72. In addition, the second gear 72 integrally rotates with the second coupling portion 59. Therefore, as the first coupling portion 58 rotates, the second coupling portion 59 rotates in the direction opposite to the rotational direction of the first coupling portion 58.

Furthermore, as a second coupling portion 59 rotates, the shutter cylinder 41 integrally rotates with the second coupling portion 59.

As described above, swinging the lever 47 in the state where the toner container 30 has been attached to the apparatus main body 2 causes the shutter cylinder 41 to rotate, and the toner discharge outlet 32 is opened.

In addition, since the second coupling portion 59 is coupled with the second rotation portion 55, when the second coupling portion 59 rotates, the second rotation portion 55 integrally rotates with the second coupling portion 59. Therefore, as the second coupling portion 59 rotates, the arm 55*b* of the second rotation portion 55 integrally rotates with the shutter cylinder 41. Furthermore, when the arm 55*b* is rotated, the locking portion 61*a* of the detection bar 61 is locked to the outer circumferential side surface of the arm 55*b*, or is removed from and is not locked to the outer circumferential side surface of the arm 55*b*. As a result, when the second rotation portions 55 is rotated integrally with the shutter cylinders 41 and all of the toner discharge outlets 32 are opened, the open state thereof is detected by the detection mechanism 60.

Thus, according to the present embodiment, the first coupling portion 58 and the second coupling portion 59 allow for attachment of the toner containers 30 to the apparatus main body 2 of a predetermined model, while not allowing for attachment thereof to the apparatus main bodies of the other models. It is thus possible to cause the toner containers 30 to be used by the image forming apparatus 1 of the predetermined model.

It is noted here that the first coupling portion 58 and the second coupling portion 59 are such portions that provide the non-compatible function of the toner containers 30, and that, by combining the shapes of the first coupling portion 58 and the second coupling portion 59, it is possible to prepare a various number of shape patterns for the portion that provides the non-compatible function. Therefore, according to the present embodiment, it is possible to appropriately restrict a plurality of types of toner, which are different from the type of toner suitable for the image forming apparatus 1, from being used in the image forming apparatus 1.

Furthermore, the lever 47, which is used to open and close the toner discharge outlet 32, is provided on the apparatus main body 2, not on the toner container 30. This prevents the toner discharge outlet 32 from being opened even if the lever 47 is operated before the toner container 30 is attached to the apparatus main body 2. As a result, according to the present embodiment, it is possible to suitably restrict the toner from being leaked from the toner container 30 before the toner container 30 is attached to the apparatus main body 2.

Furthermore, in the state where the first coupling groove 54*a* and the second coupling groove 55*a* are disposed parallel to each other, it is possible, by sliding and moving the toner container 30 in the groove length direction of the first coupling groove 54*a* and the second coupling groove 55*a*, for the first coupling portion 58 to be inserted and fitted in the first coupling groove 54*a*, and for the second coupling portion 59 to be inserted and fitted in the second coupling groove 55*a*. In such a manner, the toner containers 30 can be attached to the apparatus main body 2.

Furthermore, when the lever is swung, the first coupling portion 58 and the second coupling portion 59 are respectively rotated, and portions of the first portion 59*a* of the first coupling portion 58 and the second coupling portion 59, which extend linearly, are not disposed parallel to each other. This makes it possible to use the first coupling portion 58 and the second coupling portion 59 as a mechanism for preventing the toner containers 30 from being removed from the apparatus main body 2.

Furthermore, the first coupling groove 54*a* and the second coupling groove 55*a* are configured to be different in groove width. This makes it possible to increase the number of combinations of the shapes of the first coupling groove 54*a* and the second coupling groove 55*a*. Thus it is possible to further increase the non-compatible shape patterns that are shapes capable of providing the non-compatible function of the toner containers 30.

Here, when the first coupling portion 58 is appropriately coupled with the first rotation portion 54, and the second coupling portion 59 is appropriately coupled with the second rotation portion 55, the sensor 62 can detect that the second rotation portion 55 was rotated. This enables the detection mechanism 60 to detect the open state of the toner discharge outlet 32. However, if the first coupling portion 58 or the second coupling portion 59 is removed, the second rotation portion 55 is not rotated even if the lever 47 is swung. In that case, the detection mechanism 60 cannot detect the open state of the toner discharge outlet 32, and the image forming apparatus 1 may not be used appropriately.

For example, suppose that the first coupling portion 58 was not removed, but the second coupling portion 59 was removed. In that case, when the lever 47 is swung, the shutter cylinder 41 is rotated and the toner discharge outlet 32 is opened, but the second rotation portion 55 is not rotated. As a result, the detection mechanism 60 cannot detect the open state of the toner discharge outlet 32.

Therefore, according to the present embodiment, it is possible to restrict the toner container 30 from being used inappropriately in the state where the first coupling portion 58 or the second coupling portion 59 has been removed.

In the present embodiment, the first gear 71 and the second gear 72 are provided such that the first coupling portion 58 and the second coupling portion 59 rotate in conjunction with each other. However, not limited to this configuration, for example, a transmission belt or the like may be used for the first coupling portion 58 and the second coupling portion 59 to rotate in conjunction with each other.

In the present embodiment, a laser printer is described as an example of the image forming apparatus 1. However, not limited to this, the image forming apparatus 1 of the present disclosure may be another image forming apparatus such as a copier, a scanner device, a multifunction peripheral, or the like.

As described above, the present disclosure is useful as a toner container and an image forming apparatus including thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body; and a toner container attached to the apparatus main body, wherein the apparatus main body includes a first rotation portion, a second rotation portion, and a lever, the first rotation portion and the second rotation portion being provided each rotatably, in alignment with each other at one end of the apparatus main body in a front-rear direction of the apparatus main body, and the lever being provided integrally with the first rotation portion, the toner container includes a housing for storing toner, a toner discharge outlet formed on the housing, an opening/closing mechanism provided on the housing and configured to open and close the toner discharge outlet, and a first coupling portion that is provided rotatably with respect to the housing and configured to, when the toner container is attached to the apparatus main body, be coupled with the first rotation portion of the apparatus main body to be integrally rotatable therewith, the opening/closing mechanism includes a second coupling portion configured to, when the toner container is attached to the apparatus main body, be coupled with the second rotation portion of the apparatus main body to be integrally rotatable therewith, the opening/closing mechanism being configured to open and close the toner discharge outlet as the second coupling portion is rotated, and the first coupling portion includes a first gear, the second coupling portion includes a second gear, both the first gear and the second gear are disposed at the one end of the apparatus main body, and the first coupling portion and the second coupling portion are configured to rotate in conjunction with each other by meshing of the first gear and the second gear with each other.

2. The image forming apparatus according to claim 1, further comprising a detection mechanism including the second rotation portion and a sensor capable of detecting rotation of the second rotation portion, the detection mechanism detecting that the toner discharge outlet of the toner container attached to the apparatus main body is in an open state, based on a detection result of the sensor.

3. The image forming apparatus according to claim 1, wherein the first rotation portion includes a first coupling groove extending linearly at least in part, the second rotation portion includes a second coupling groove extending linearly at least in part, the first coupling portion has a shape of a projection so as to be fitted in the first coupling groove of the first rotation portion, and the second coupling portion has a shape of a projection so as to be fitted in the second coupling groove of the second rotation portion.

4. The image forming apparatus according to claim 3, wherein the first coupling groove is different from the second coupling groove in groove width.

5. A toner container comprising:

a housing attached to an apparatus main body of an image forming apparatus and configured to store toner;

a toner discharge outlet formed on the housing;

an opening/closing mechanism provided on the housing and configured to open and close the toner discharge outlet; and a first coupling portion that is provided rotatably with respect to the housing, wherein the apparatus main body includes a first rotation portion, a second rotation portion, and a lever, the first rotation portion and the second rotation portion being provided each rotatably, in alignment with each other at one end of the apparatus main body in a front-rear direction of the apparatus main body, and the lever being provided integrally with the first rotation portion, the first coupling portion is configured to, when the toner container is attached to the apparatus main body, be coupled with the first rotation portion of the apparatus main body to be integrally rotatable therewith, the opening/closing mechanism includes a second coupling portion configured to, when the toner container is attached to the apparatus main body, be coupled with the second rotation portion of the apparatus main body to be integrally rotatable therewith, the opening/closing mechanism being configured to open and close the toner discharge outlet as the second coupling portion is rotated, and the first coupling portion includes a first gear, the second coupling portion includes a second gear, both the first gear and the second gear are disposed at the one end of the apparatus main body, and the second coupling portion and the first coupling portion are configured to rotate in conjunction with each other by meshing of the first gear and the second gear with each other.

6. The toner container according to claim 5, wherein the first rotation portion includes a first coupling groove extending linearly at least in part, the second rotation portion includes a second coupling groove extending linearly at least in part, the first coupling portion has a shape of a projection so as to be fitted in the first coupling groove of the first rotation portion, and the second coupling portion has a shape of a projection so as to be fitted in the second coupling groove of the second rotation portion.

7. The toner container according to claim 6, wherein the first coupling groove is different from the second coupling groove in groove width.

* * * * *